United States Patent [19]

Livesey et al.

[11] Patent Number: 4,829,278

[45] Date of Patent: May 9, 1989

[54] CIRCUIT BREAKER TRIP BAR INTERLOCK

[75] Inventors: John K. Livesey, Carnegie; Alfred E. Maier, Chippewa; Melvin A. Carrodus, Brighton Township, Beaver County, all of Pa.

[73] Assignee: Westinghouse Electric Corp., Pittsburgh, Pa.

[21] Appl. No.: 227,577

[22] Filed: Aug. 3, 1988

[51] Int. Cl.[4] ..... H01H 61/00; H01H 71/16

[52] U.S. Cl. ..... 337/50; 337/48; 200/51.09; 335/172

[58] Field of Search ..... 337/46, 48, 49, 79, 337/50; 335/8, 9, 10, 172, 6, 13; 200/61.74, 61.73, 51.09

[56] References Cited

U.S. PATENT DOCUMENTS 3,341,791 9/1967 Leonard ..... 337/48

4,128,822 12/1978 Peterson, Jr. ..... 337/50

*Primary Examiner*—H. Broome

*Attorney, Agent, or Firm*—M. J. Moran

[57] ABSTRACT

A trip bar interlock for a circuit breaker characterized by an electrically insulating housing having an apertured bottom wall. A rotatable trip bar is in the housing for releasably holding the circuit breaker in an untripped condition. An actuator is provided for releasing the trip bar when the circuit breaker is dismounted from a mounting surface. The trip bar and the actuator have engaging surfaces and the actuator has an end portion extending through the aperture. The actuator is biased toward the mounting wall.

7 Claims, 2 Drawing Sheets

CIRCUIT BREAKER TRIP BAR INTERLOCK

BACKGROUND OF THE INVENTION

1. Field of the Invention

This invention relates to a trip bar interlock for a circuit breaker and, more particularly, it pertains to a device for automatically tripping a circuit breaker if removed from its location.

2. Description of the Prior Art

Although many different types of circuit breakers are manufactured, they all are comprised of five primary components: molded case (frame), operating mechanism, arc extinguishers, contacts, trip elements, and thermal connectors. The function of the trip element is to trip the operating mechanism in the event of a prolonged overload, short circuit current, or damaging around faults. To accomplish this, an electro-mechanical or a solid state trip is provided.

Manifestly, trip elements, whether they are electro-mechanical or solid state, are necessary to ensure safe operation and protect electrical circuits as well as personnel. In addition, it sometimes happens that circuit breakers are dismounted from their positions on a mounting surface without preliminarily determining whether or not the circuit breaker has been tripped. Accordingly, there is a need for automatically tripping a circuit breaker, if and when it is removed from its location.

SUMMARY OF THE INVENTION

In accordance with this invention, a trip bar interlock for a circuit breaker mounted on a mounting surface is provided, the breaker comprising an electrically insulating housing having a bottom wall, an operating mechanism for operating the contacts and comprising a pivotally supported releasable member, latching means for latching the releasable member and including a latch lever movable between latched and unlatched positions of the releasable member, trip means including a rotatable trip bar for releasably holding the latch lever in the latched position, the trip bar having a radially extending surface, means for tripping the trip bar in response to predetermined overload conditions, an actuator having a second surface engaging the radially extending surface, and having an end portion extending through a hole in the bottom wall, and means biasing the actuator end portion against the bottom wall and for moving the first surface against the radially extending surface to rotate the trip bar to tripped position when the circuit breaker is dismounted from the mounting wall.

The advantage of the device of this invention is that it can be either factory-assembled and fitted, or fitted on site.

DESCRIPTION OF THE PREFERRED EMBODIMENTS

Figure 1:
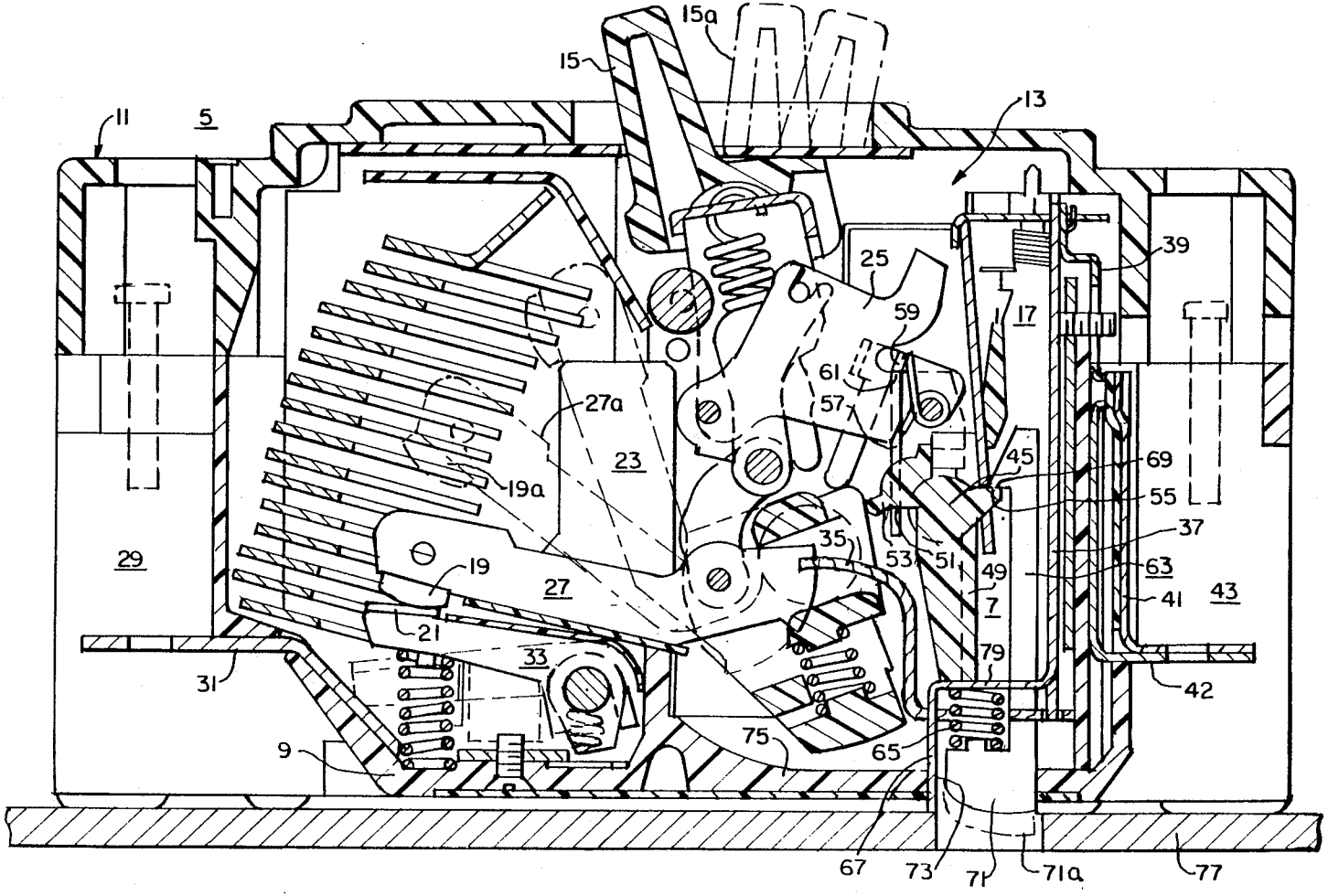
FIG. 1 is a vertical sectional view through the center of a pole or a phase of a multiple circuit breaker.

In FIG. 1 a molded case circuit breaker is generally indicated at 5. Though the circuit breaker may be a three-phase or a three-pole structure, the principles of the present invention disclosed herein are equally applicable to single-phase or other polyphase circuit breakers and to both AC and DC circuit breakers. The present invention concerns a trip bar interlock generally indicated at 7 in combination with the circuit breaker 5. A detailed description of the circuit breaker is set forth in U.S. Pat. No. 4,691,180, which is incorporated herein by reference.

The circuit breaker 5 comprises a housing including a base 9 and a cover 11. An operating mechanism 13 functions either in response to movement of a handle 15, which is part of the mechanism 13, or in response to a trip unit 17, to move a movable contact 19 into an out-of-closed and open positions with respect to a lower contact 21. In addition to the handle 15, the operating mechanism 13 includes an over-center toggle mechanism 23 together with a releasable lever 25 that is detachably connected to the trip unit 17, whereby upon release of the unit the contacts 19, 21 separate with a contact arm 27 moving to a contact open position indicated by the broken line position 27*a*, and with a handle 15 moving to the position 15*a*.

In the closed-contact position, a circuit through the circuit breaker 5 moves from a line terminal 29 through a conductor 31, a lower contact arm 33, contacts 21, 19; upper contact arm 27, a flexible conductor or shunt 35, a bimetal 37, and then through conductors 39, 41, 42; and a terminal 43.

The trip unit 17 comprises a trip bar 45 having a rotatable or axial portion 47, a lower flange 49, a latch surface 51, a release surface 53, and an interlock surface 55. A trip unit 17 also includes a latch lever 57 having an upper inclined portion 59 engaging a notch 61 in the releasable lever 25. When the trip bar 45 is rotated clockwise, the latch lever 57 rotates clockwise from engagement with the latch surface 51 to a position adjacent the release surface 53 and the inclined portion 59 rotates out of the notch 61 to release the release lever 25, whereby the contact 19 moves to the open broken line position 19*a*.

In accordance with this invention, the circuit breaker 5 is provided with the trip bar interlock 7 which comprises an actuator 63, bias means or spring 65, and a housing 67. The upper end portion of the actuator 63 comprises a strike surface 69 which engages the radially outwardly-extending interlock surface 55. Thus, the upper end portion of the actuator has a hook configuration. The lower end portion 71 of the actuator 63 ascends through an opening 73 in a bottom wall 75 of the housing base 9. In the position shown in FIG. 1 the lower end portion 71 is retained in the position shown by engagement with a mounting wall 77 against the pressure of the spring 65. The spring is disposed between the lower end portion 71 of the actuator 63 and a wall 79 of the housing 67, the lower end of which is retained in the bottom wall 75. When the circuit breaker 5 is mounted on the mounting wall 77, the lower end portion 71 is retained against the mounting wall 77 by the spring 65. However, when the circuit breaker 5 is dismounted from the mounting wall 77, the lower end portion 71 is moved to the broken line position 71(*a*), whereupon the strike surface 69 of the actuator 63 moves against the interlock surface 55 of the trip bar 45, and thereby rotates the trip bar clockwise to the trip position of the circuit breaker.

Figure 2:
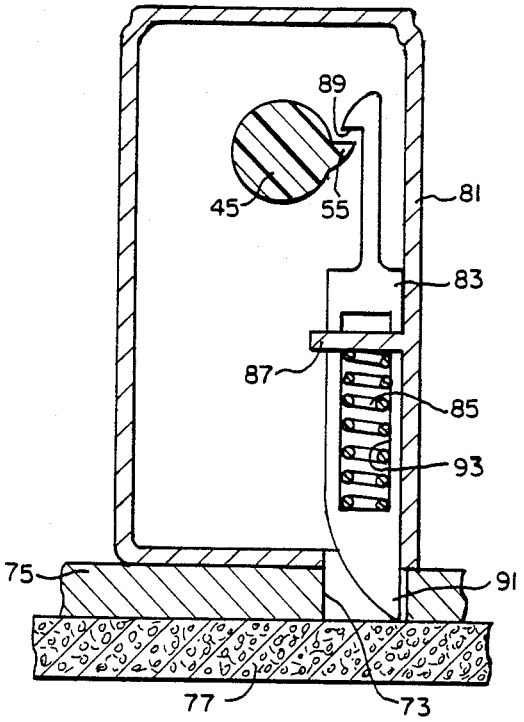
FIG. 2 is a sectional view through a trip bar interlock of another embodiment in the unactuated position.
Figure 3:
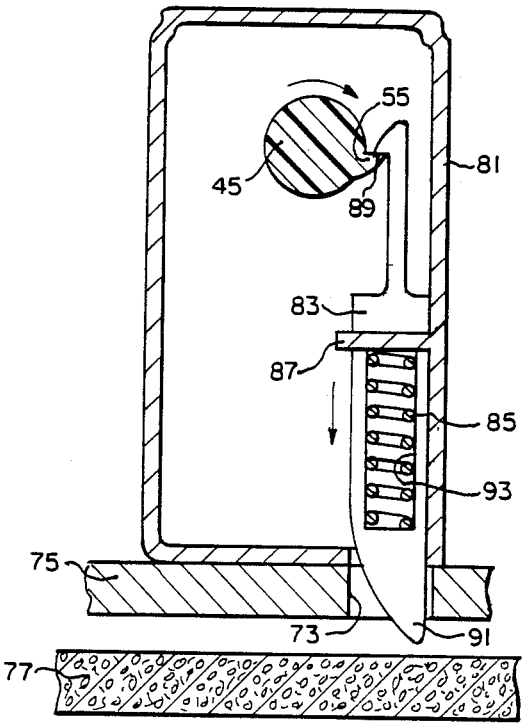
FIG. 3 is a view of the device shown in FIG. 2 in the actuated position.

Another embodiment of the invention is shown in FIGS. 2 and 3 in which similar numerals refer to similar parts. The trip bar interlock of FIGS. 2 and 3 comprises an enclosure 81 surrounding the trip bar 45 and enclosing an actuator 83 and compression spring 85. The enclosure 81 includes an inturned flange portion 87 having a slot through which the actuator 83 is slidably mounted. The upper end portion of the actuator 83 includes a strike surface 89 of the hook-shaped upper end portion thereof. As shown in FIG. 2, when the circuit breaker is mounted on the mounting wall 77, the lower end portion 91 of the actuator 83 engages the mounting wall 77 and retains the actuator in the retracted position against the pressure of the spring 85. The spring is preferably mounted in a window 93 of the actuator with the lower end of the spring bearing against the lower edge of the window and the upper end of the spring bearing against the flange portion 87.

As shown in FIG. 3, when the circuit breaker is dismounted from the mounting wall 77, the lower end portion 91 of the actuator is pushed downwardly through the opening 73 of the base 75, whereby the strike surface 89 of the actuator moves against the interlock surface and thereby rotates the tie bar 45 clockwise to the trip position in a manner similar to that shown in FIG. 1.

Accordingly, the device of this invention provides a trip bar interlock which automatically trips the breaker when it is removed from its location. The device can be provided either in a factory-assembled form and fitted (FIG. 1) or it can be fitted on site as shown in the assembled structure of FIGS. 2 and 3.

What is claimed is:

1. A trip bar interlock for a circuit breaker mounted on a mounting surface, comprising:

an electrically insulating housing having a bottom wall; contacts;

an operating mechanism for operating the contacts and comprising a pivotally supported releasable member;

latching means for latching the releasable member and including a latch lever movable between latched and unlatched positions of the releasable member;

trip means including a rotatable trip bar for releasably moving the latch lever into the latched position;

the trip bar having a FIRST surface;

means for tripping the trip bar in response to predetermined overcurrent conditions;

an actuator having a second surface aligned with the path of movement of the FIRST surface and having an end portion extending through a hole in the bottom wall; and means biasing the actuator end portion against the mounting surface and for moving the second surface against the FIRST surface to rotate the trip bar to tripped position when the circuit breaker is dismounted from the mounting surface.

2. The interlock of claim 1 in which the first surface is a radially extending surface.

3. The interlock of claim 2 in which the trip bar has a projection from one side thereof which projection comprises the first surface.

4. The interlock of claim 3 in which the first and second surfaces are in facing alignment in the untripped position of the trip bar.

5. The interlock of claim 4 in which the actuator is an elongated member extending between the projection and the hole in the bottom wall.

6. The interlock of claim 5 in which the actuator includes a hook on which the second surface is disposed.

7. The interlock of claim 6 in which the biasing means comprises a spring for moving the second surface against the first surface.

* * * * *